US011387069B2

(12) United States Patent
Yoshida et al.

(10) Patent No.: US 11,387,069 B2
(45) Date of Patent: Jul. 12, 2022

(54) ELECTRON-EMITTING ELECTRODE INCLUDING MULTIPLE DIAMOND MEMBERS AND MAGNETRON INCLUDING SAME

(71) Applicant: KABUSHIKI KAISHA TOSHIBA, Tokyo (JP)

(72) Inventors: Hisashi Yoshida, Kawasaki Kanagawa (JP); Hisao Miyazaki, Yokohama Kanagawa (JP); Shigeya Kimura, Yokohama Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 17/373,565

(22) Filed: Jul. 12, 2021

(65) Prior Publication Data

US 2022/0181112 A1 Jun. 9, 2022

(30) Foreign Application Priority Data

Dec. 3, 2020 (JP) ..... JP2020-201039

(51) Int. Cl.
*H01J 23/05* (2006.01)
*H01J 25/50* (2006.01)

(52) U.S. Cl.
CPC ..... *H01J 23/05* (2013.01); *H01J 25/50* (2013.01)

(58) Field of Classification Search
CPC ..... H01J 23/05
See application file for complete search history.

(56) References Cited

U.S. PATENT DOCUMENTS

2008/0134959 A1 6/2008 Kasu et al.

FOREIGN PATENT DOCUMENTS

| | | | |
|---|---|---|---|
| JP | H9-161655 | A | 6/1997 |
| JP | 2004-241352 | A | 8/2004 |
| JP | 2005-44542 | A | 2/2005 |
| JP | WO2006/137401 | A1 | 12/2006 |
| JP | 2008-177017 | A | 7/2008 |
| JP | 2009-26594 | A | 2/2009 |
| JP | 2009-129962 | A | 6/2009 |

*Primary Examiner* — Joseph L Williams
(74) *Attorney, Agent, or Firm* — Finnegan, Henderson, Farabow, Garrett & Dunner L.L.P.

(57) ABSTRACT

According to one embodiment, an electron-emitting electrode includes a first member, a first diamond member, and a second diamond member. A surface of the first member includes a first region and a second region. The first diamond member is provided at the first region. The first diamond member includes a first element that includes at least one of nitrogen, phosphorus, arsenic, antimony, and bismuth. The second diamond member is provided at the second region. The second diamond member includes a second element that includes at least one of boron, aluminum, gallium, and indium.

20 Claims, 7 Drawing Sheets

ELECTRON-EMITTING ELECTRODE INCLUDING MULTIPLE DIAMOND MEMBERS AND MAGNETRON INCLUDING SAME

CROSS-REFERENCE TO RELATED APPLICATIONS

This application is based upon and claims the benefit of priority from Japanese Patent Application No. 2020-201039, filed on Dec. 3, 2020; the entire contents of which are incorporated herein by reference.

FIELD

Embodiments described herein relate generally to an electron-emitting electrode and a magnetron.

BACKGROUND

For example, an electron-emitting electrode such as a thermionic element or the like is provided in a magnetron. It is desirable to increase the efficiency of the electron-emitting electrode.

DETAILED DESCRIPTION

Figure 1A:
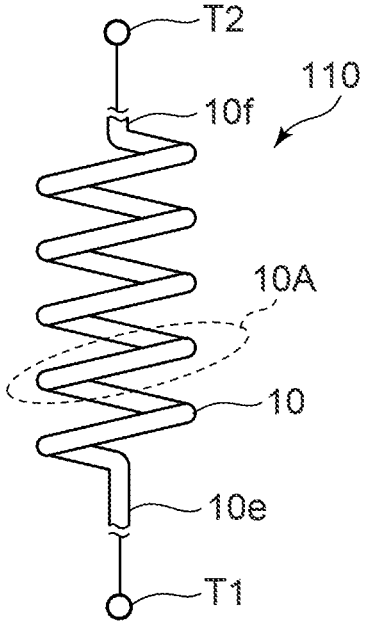
FIGS. 1A to 1D are schematic views illustrating an electron-emitting electrode according to a first embodiment.

According to one embodiment, an electron-emitting electrode includes a first member, a first diamond member, and a second diamond member. A surface of the first member includes a first region and a second region. The first diamond member is provided at the first region. The first diamond member includes a first element. The first element includes at least one selected from the group consisting of nitrogen, phosphorus, arsenic, antimony, and bismuth. The second diamond member is provided at the second region. The second diamond member includes a second element. The second element including at least one selected from the group consisting of boron, aluminum, gallium, and indium.

According to one embodiment, a magnetron includes the electron-emitting electrode described above, and an opposite electrode facing the electron-emitting electrode. A gap is provided between the electron-emitting electrode and the opposite electrode.

Various embodiments are described below with reference to the accompanying drawings.

The drawings are schematic and conceptual; and the relationships between the thickness and width of portions, the proportions of sizes among portions, etc., are not necessarily the same as the actual values. The dimensions and proportions may be illustrated differently among drawings, even for identical portions.

In the specification and drawings, components similar to those described previously or illustrated in an antecedent drawing are marked with like reference numerals, and a detailed description is omitted as appropriate.

First Embodiment

FIGS. 1A to 1D are schematic views illustrating an electron-emitting electrode according to a first embodiment.

Figure 1B:
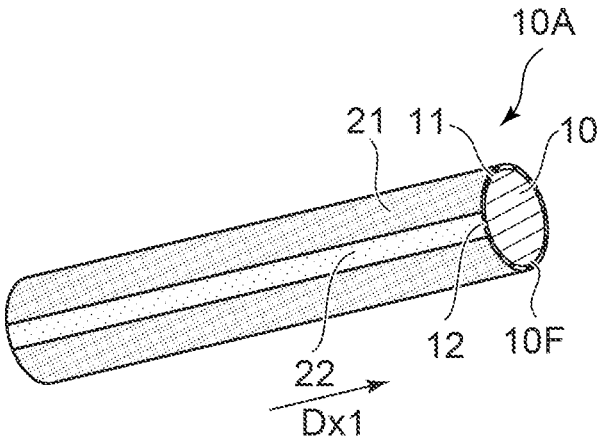
Figure 1C:
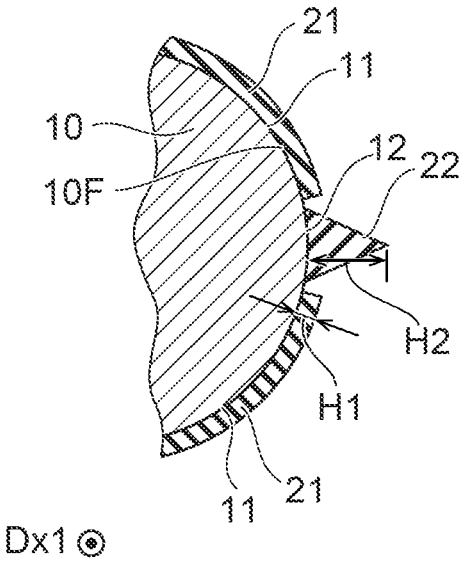
Figure 1D:
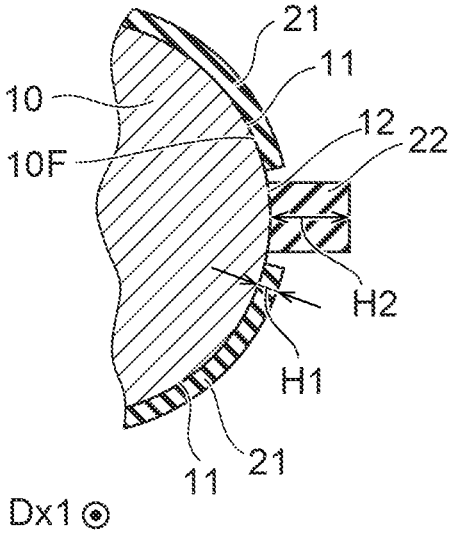

FIG. 1A is a side view. FIG. 1B is a perspective view in which a portion 10A of FIG. 1A is extracted. FIG. 1C is a cross-sectional view of one example of the electron-emitting electrode. FIG. 1D is a cross-sectional view of another example of the electron-emitting electrode.

As shown in FIGS. 1A and 1B, the electron-emitting electrode 110 according to the embodiment includes a first member 10, a first diamond member 21, and a second diamond member 22.

In the example as shown in FIG. 1A, the first member 10 is spiral-shaped. The first member 10 is, for example, a filament. The first member 10 includes, for example, tungsten. The first member 10 may include, for example, tungsten and at least one selected from the group consisting of thorium oxide and cerium oxide. The tungsten concentration in the first member 10 is, for example, not less than 90%. The melting points of these materials are high. For example, any material that has a melting point that is not less than 1200° C. may be used as the first member 10. The first member 10 is, for example, conductive.

As shown in FIGS. 1B to 1D, a surface 10F of the first member 10 includes a first region 11 and a second region 12. In the example as shown in FIG. 1B, the first region 11 and the second region 12 are along a direction Dx1 in which the first member 10 extends.

The first diamond member 21 is located at the first region 11. The first diamond member 21 includes diamond and a first element. The first element includes at least one selected from the group consisting of nitrogen, phosphorus, arsenic, antimony, and bismuth. For example, the first diamond member 21 is of an n-type.

The second diamond member 22 is located at the second region 12. The second diamond member 22 includes diamond and a second element. The second element includes at least one selected from the group consisting of boron, aluminum, gallium, and indium. For example, the second diamond member 22 is of a p-type.

As shown in FIG. 1A, the electron-emitting electrode 110 may include a first electrode terminal T1 and a second electrode terminal T2. The first electrode terminal T1 is electrically connected with a first end portion 10*e* of the first member 10. The second electrode terminal T2 is electrically connected with a first other-end portion 10*f* of the first member 10. The temperature of the first member 10 is increased by supplying a current to these terminals. Electrons are emitted from the first and second diamond members 21 and 22 as the temperature of the first member 10 increases.

For example, thermions are emitted from the first diamond member 21. For example, primary electrons are emitted from the first diamond member 21. For example, secondary electrons are emitted from the second diamond member 22. For example, the electron-emitting electrode 110 is applicable as the cathode of a magnetron, etc. In such a case, for example, the electrons that are emitted from the first diamond member 21 are incident on the second diamond member 22. Thereby, secondary electrons are emitted from the second diamond member 22.

For example, conductive diamond has negative electron affinity. The conduction band level of such a material is higher than the vacuum level. Electrons are easily emitted from such a material. Electrons are easily emitted by the cathode that includes conductive diamond even when the temperature of the first member 10 is low. For example, n-type diamond is used as the conductive diamond that emits the primary electrons.

For example, when the electron-emitting electrode 110 is used as the cathode of a magnetron, etc., a portion of the thermions that are emitted has cyclotron motion and strikes the cathode due to a reverse impact phenomenon. The cathode can efficiently emit secondary electrons by including a material that has a high emission efficiency of secondary electrons. Conductive diamond can be used as the material that emits secondary electrons. For example, p-type diamond is used as the material that emits secondary electrons.

According to the embodiment, the electron emission of the second diamond member 22 can be utilized in addition to the emission of the electrons from the first diamond member 21. A highly efficient electron emission is obtained thereby. According to the embodiment, an electron-emitting electrode is provided in which the efficiency can be increased.

For example, a reference example may be considered in which a metal oxide or the like is provided instead of p-type diamond. The emission efficiency of secondary electrons of the reference example is low. According to the embodiment, secondary electrons can be emitted with high efficiency by providing the p-type second diamond member 22.

As shown in FIGS. 1C and 1D, the first diamond member 21 and the second diamond member 22 are separated from each other.

The surface of one of the first diamond member 21 or the second diamond member 22 may include a surface asperity. For example, the surface asperity of these members may be caused by the diamond crystal grains.

For example, the second diamond member 22 may include an uneven configuration (including a protruding shape) having a depth that is not more than 50 μm. Secondary electrons are easily emitted by the uneven configuration.

As shown in FIGS. 1C and 1D, the height of the first diamond member 21 referenced to the first region 11 (the surface 10F of the first member 10) is taken as a first height H1. For example, the first height H1 corresponds to the thickness of the first diamond member 21. The height of the second diamond member 22 referenced to the second region 12 (the surface 10F of the first member 10) is taken as a second height H2. For example, the second height H2 corresponds to the thickness of the second diamond member 22. According to the embodiment, it is favorable for the second height H2 to be greater than the first height H1. The surface area of the surface of the second diamond member 22 is substantially increased thereby. Thereby, for example, the incidence of the electrons on the second diamond member 22 and the emission of the electrons from the second diamond member 22 are more efficient. A higher efficiency is obtained.

According to the embodiment, the second height H2 is not less than 1.5 times and not more than 10 times the first height H1. For example, the second height H2 is not more than 5 μm. Thereby, the emission of the electrons from the second diamond member 22 is easier.

As shown in FIG. 1C, the top of the second diamond member 22 may be conic. The top of the second diamond member 22 may be planar.

According to the embodiment, it is favorable for the ratio of the surface area of the second region 12 to the surface area of the first region 11 to be not more than 0.1. For example, the surface area of the first region 11 is not less than 10 times the surface area of the second region 12. For example, the surface area of the first diamond member 21 is not less than 10 times the surface area of the second diamond member 22. Thereby, a high amount of primary electrons is emitted from the first diamond member 21. A high amount of primary electrons increases the amount of the electrons incident on the second diamond member 22. As a result, a high amount of secondary electrons is emitted from the second diamond member 22.

In the example as shown in FIG. 1B, the second diamond member 22 extends along the direction Dx1 in which the first member 10 extends. In the example, the first region 11 is located along a portion of the circumference having the direction Dx1 in which the first member 10 extends as the center; and the second region 12 is located at the other portion of the circumference.

According to the embodiment, the surface 10F of the first member 10 may include multiple first regions 11. For example, multiple first diamond members 21 may be provided. The second region 12 may be located between one of the multiple first regions 11 and another one of the multiple first regions 11. For example, one of the multiple first diamond members 21 is located at the one of the multiple first regions 11. Another one of the multiple first diamond members 21 is located at the other one of the multiple first regions 11. For example, the ratio of the surface area of the second region 12 to the sum of the surface areas of the multiple first regions 11 is not more than 0.1. For example, the ratio of the surface area of the second diamond member 22 to the sum of the surface areas of the multiple first diamond members 21 is not more than 0.1.

According to the embodiment, the surface 10F of the first member 10 may include multiple second regions 12. For example, multiple second diamond members 22 may be provided. For example, the one of the multiple first regions 11 may be between one of the multiple second regions 12 and another one of the multiple second regions 12. One of the multiple second diamond members 22 is located at the one of the multiple second regions 12. Another one of the multiple second diamond members 22 is located at the other one of the multiple second regions 12. For example, the ratio of the sum of the surface areas of the multiple second regions 12 to the sum of the surface areas of the multiple first regions 11 is not more than 0.1. For example, the ratio of the sum of the surface areas of the multiple second diamond members 22 to the sum of the surface areas of the multiple first diamond members 21 is not more than 0.1.

Figure 2A:
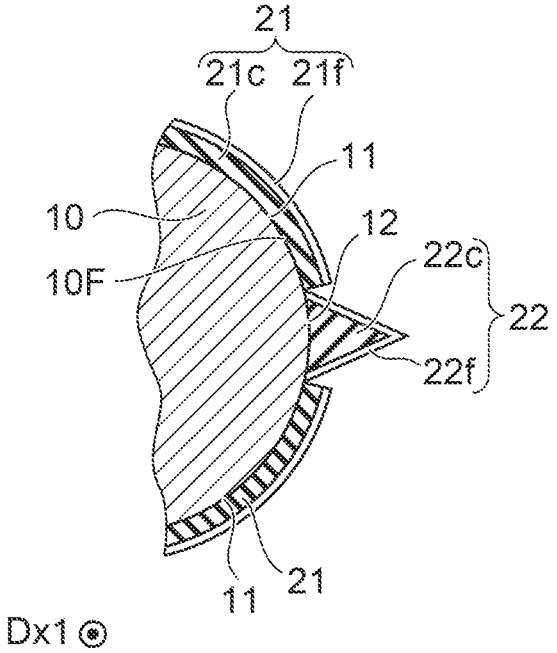
FIGS. 2A and 2B are schematic cross-sectional views illustrating the electron-emitting electrode according to the first embodiment.
Figure 2B:
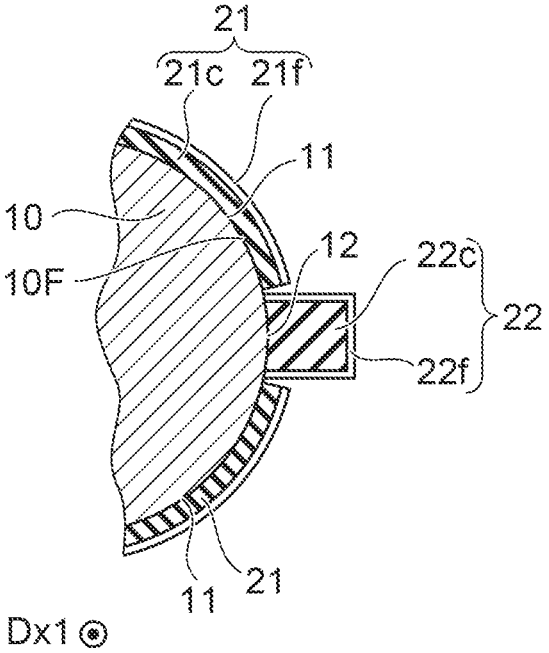

FIGS. 2A and 2B are schematic cross-sectional views illustrating the electron-emitting electrode according to the first embodiment.

As shown in FIGS. 2A and 2B, the first diamond member 21 includes a first polycrystal 21*c*. The first diamond member 21 may include a first hydrogen region 21*f*. The first hydrogen region 21*f* is located at the surface of the first polycrystal 21*c*. The first hydrogen region 21*f* includes hydrogen. The first hydrogen region 21*f* is, for example, a hydrogen termination region.

As shown in FIGS. 2A and 2B, the second diamond member 22 includes a second polycrystal 22*c*. The second diamond member 22 may include a second hydrogen region 22*f*. The second hydrogen region 22*f* is located at the surface of the second polycrystal 22*c*. The second hydrogen region 22*f* includes hydrogen. The second hydrogen region 22*f* is, for example, a hydrogen termination region.

For example, a homogeneous diamond member is easily obtained by the diamond member including a polycrystal. For example, an efficient electron emission is stably and easily obtained by the diamond member including a hydrogen region.

Figure 3A:
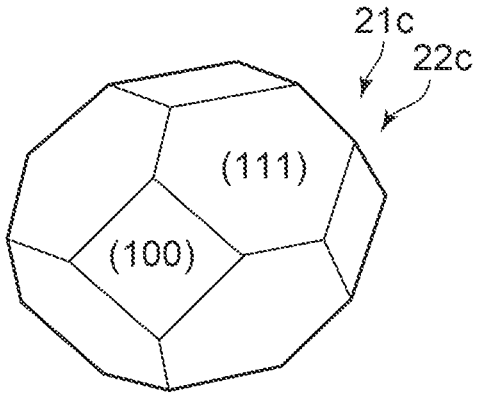
FIGS. 3A to 3C are schematic perspective views illustrating a portion of the electron-emitting electrode according to the first embodiment.
Figure 3B:
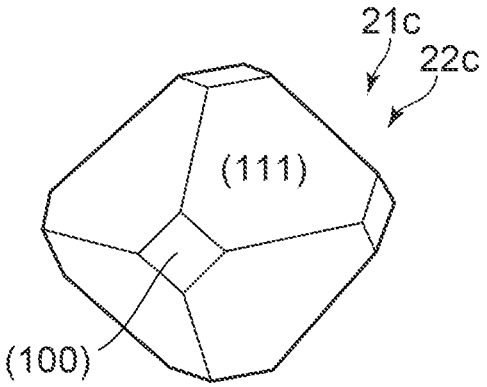
Figure 3C:
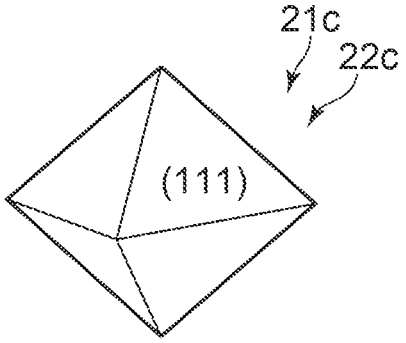

FIGS. 3A to 3C are schematic perspective views illustrating a portion of the electron-emitting electrode according to the first embodiment.

These drawings illustrate the first polycrystal 21*c* or the second polycrystal 22*c*.

In the example of FIG. 3A, at least one of the first polycrystal 21*c* or the second polycrystal 22*c* includes a (100) plane and a (111) plane. The proportion of the (111) plane is greater than the proportion of the (100) plane.

In the example of FIG. 3B as well, at least one of the first polycrystal 21*c* or the second polycrystal 22*c* includes the (100) plane and the (111) plane. In the example of FIG. 3B, the proportion of the (111) plane is even greater than the proportion of the (100) plane.

In the example of FIG. 3C as well, at least one of the first polycrystal 21*c* or the second polycrystal 22*c* includes the (111) plane. The (100) plane is substantially not provided.

For example, the emission of the secondary electrons from the second diamond member 22 is more efficiently performed by increasing the proportion of the (111) plane.

For example, the second polycrystal 22*c* includes the (111) plane. The second polycrystal 22*c* does not include the (100) plane. Or, the proportion of the (100) plane in the second polycrystal 22*c* is less than the proportion of the (111) plane in the second polycrystal 22*c*. A highly efficient electron emission is easily obtained thereby.

Second Embodiment

FIGS. 4A to 4D are schematic views illustrating an electron-emitting electrode according to a second embodiment.

Figure 4A:
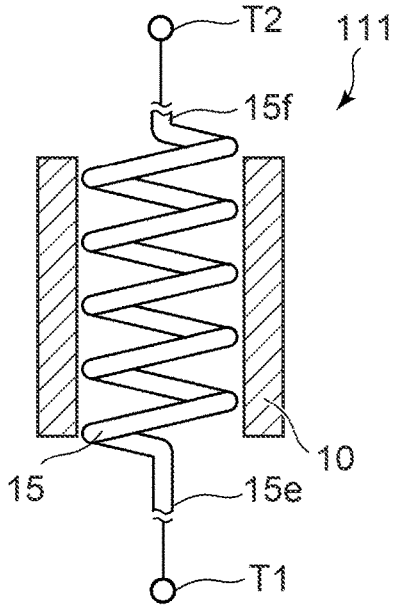
FIGS. 4A to 4D are schematic views illustrating an electron-emitting electrode according to a second embodiment.
Figure 4B:
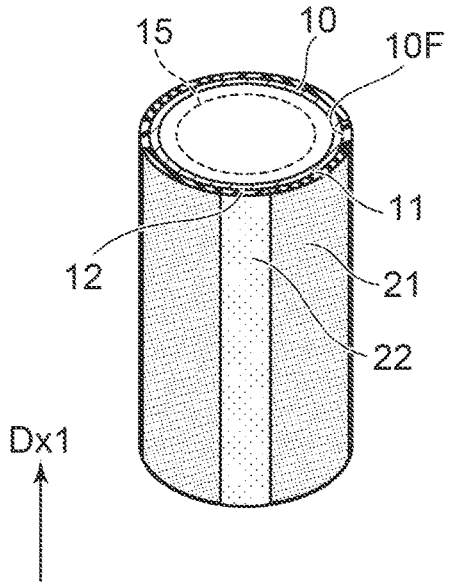
Figure 4C:
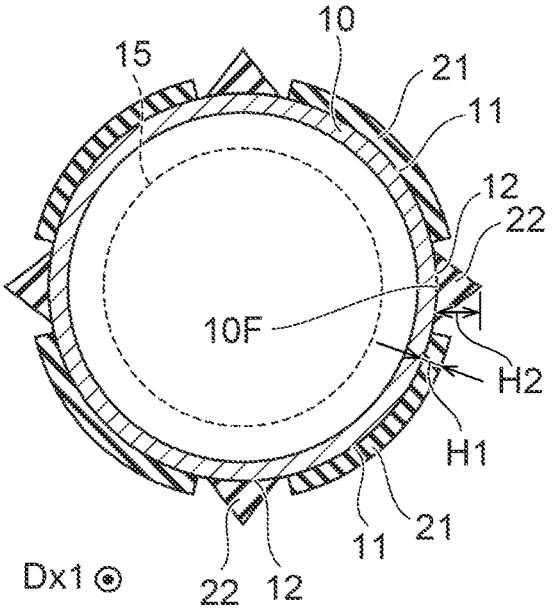
Figure 4D:
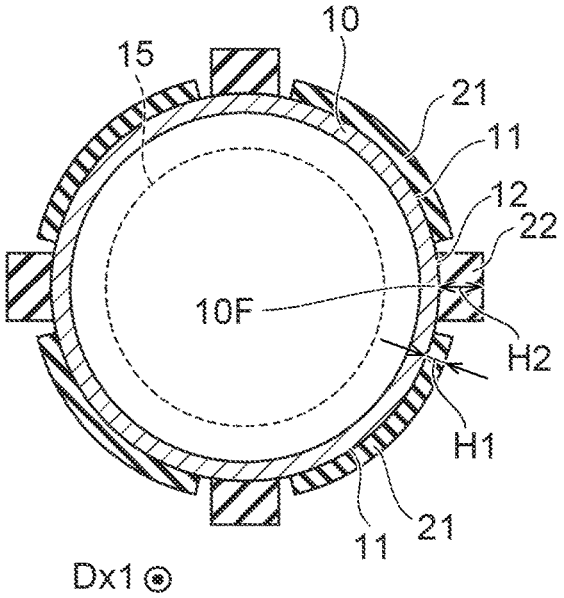

FIG. 4A is a cross section and a side view. FIG. 4B is a perspective view of a portion of the electron-emitting electrode. FIG. 4C is a cross-sectional view of one example of the electron-emitting electrode. FIG. 4D is a cross-sectional view of another example of the electron-emitting electrode.

As shown in FIGS. 4A and 4B, the electron-emitting electrode 111 according to the embodiment includes the first member 10, the first diamond member 21, the second diamond member 22, and a second member 15.

The second member 15 is conductive. The second member 15 includes, for example, tungsten. The second member 15 may include, for example, tungsten and at least one selected from the group consisting of thorium oxide and cerium oxide. The tungsten concentration in the second member 15 is, for example, not less than 90%. The melting points of these materials are high. For example, any material that has a melting point that is not less than 1200° C. may be used as the second member 15. In the example, the second member 15 is spiral-shaped.

As shown in FIG. 4A, the electron-emitting electrode 111 may include the first electrode terminal T1 and the second electrode terminal T2. The first electrode terminal T1 is electrically connected with a second end portion 15*e* of the second member 15. The second electrode terminal T2 is electrically connected with a second other-end portion 15*f* of the second member 15.

In the example as shown in FIGS. 4A and 4B, the first member 10 that is tubular (including circular tubular) is provided around the second member 15. As shown in FIGS. 4C and 4D, for example, the first member 10 is between the second member 15 and the first diamond member 21 and between the second member 15 and the second diamond member 22. The second member 15 is inside the tubular first member 10.

For example, a current is supplied between the second end portion 15*e* and the second other-end portion 15*f* via the first electrode terminal T1 and the second electrode terminal T2. The second member 15 is heated by the current. The temperature of the first member 10 is increased by the heated second member 15. Electrons are emitted from the first and second diamond members 21 and 22 as the temperature of the first member 10 increases. For example, primary electrons are emitted from the first diamond member 21. For example, secondary electrons are emitted from the second diamond member 22.

As shown in FIGS. 4C and 4D, the height of the first diamond member 21 referenced to the first region 11 (the surface 10F of the first member 10) is taken as the first height H1. The height of the second diamond member 22 referenced to the second region 12 (the surface 10F of the first member 10) is taken as the second height H2. It is favorable for the second height H2 to be greater than the first height H1. A higher efficiency is obtained.

As shown in FIGS. 4C and 4D, the surface 10F of the first member 10 may include the multiple first regions 11. For example, the second region 12 may be located between one of the multiple first regions 11 and another one of the multiple first regions 11. One of the multiple first diamond members 21 is located at the one of the multiple first regions 11. Another one of the multiple first diamond members 21 is located at the other one of the multiple first regions 11. For example, the ratio of the surface area of the second region 12 to the sum of the surface areas of the multiple first regions 11 is not more than 0.1. For example, the ratio of the surface area of the second diamond member 22 to the sum of the surface areas of the multiple first diamond members 21 is not more than 0.1.

As shown in FIGS. 4C and 4D, the surface 10F of the first member 10 may include the multiple second regions 12. For example, the one of the multiple first regions 11 may be between one of the multiple second regions 12 and another one of the multiple second regions 12. One of the multiple second diamond members 22 is located at the one of the multiple second regions 12. Another one of the multiple second diamond members 22 is located at the other one of the multiple second regions 12. For example, the ratio of the sum of the surface areas of the multiple second regions 12 to the sum of the surface areas of the multiple first regions 11 is not more than 0.1. For example, the ratio of the sum of the surface areas of the multiple second diamond members 22 to the sum of the surface areas of the multiple first diamond members 21 is not more than 0.1.

Figure 5A:
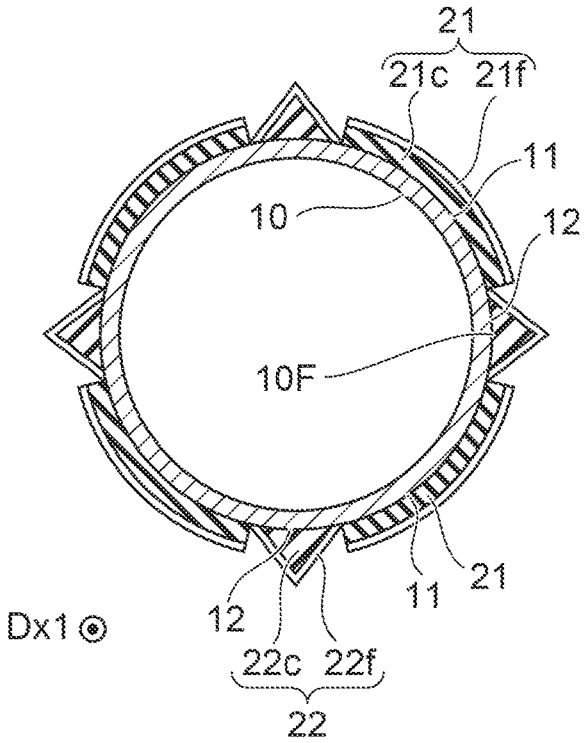
FIGS. 5A and 5B are schematic cross-sectional views illustrating the electron-emitting electrode according to the second embodiment.
Figure 5B:
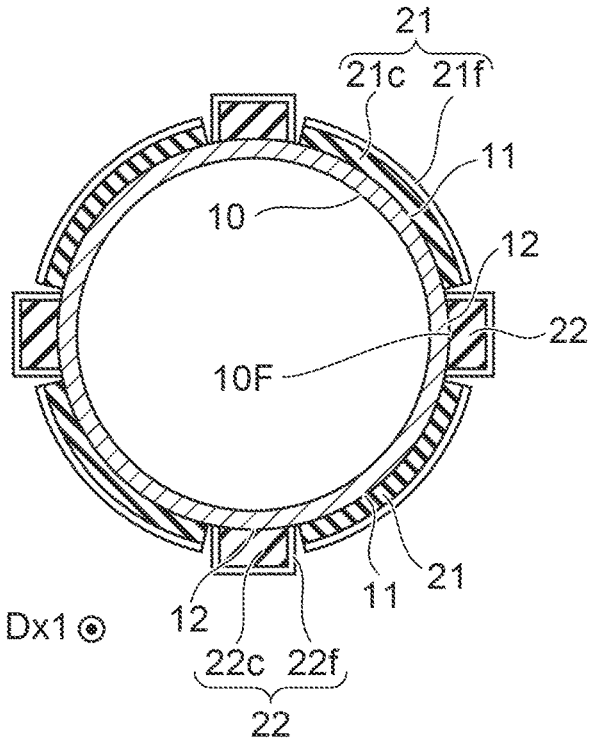

FIGS. 5A and 5B are schematic cross-sectional views illustrating the electron-emitting electrode according to the second embodiment.

As shown in FIGS. 5A and 5B, the first diamond member 21 includes the first polycrystal 21*c*. The first diamond member 21 may include the first hydrogen region 21*f*. The first hydrogen region 21*f* is located at the surface of the first polycrystal 21*c*. The first hydrogen region 21*f* includes hydrogen. As shown in FIGS. 5A and 5B, the second diamond member 22 includes the second polycrystal 22*c*. The second diamond member 22 may include the second hydrogen region 22*f*. The second hydrogen region 22*f* is located at the surface of the second polycrystal 22*c*. The second hydrogen region 22*f* includes hydrogen. Homogeneous diamond members are easily obtained. For example, an efficient electron emission is stably and easily obtained.

Third Embodiment

Figure 6A:
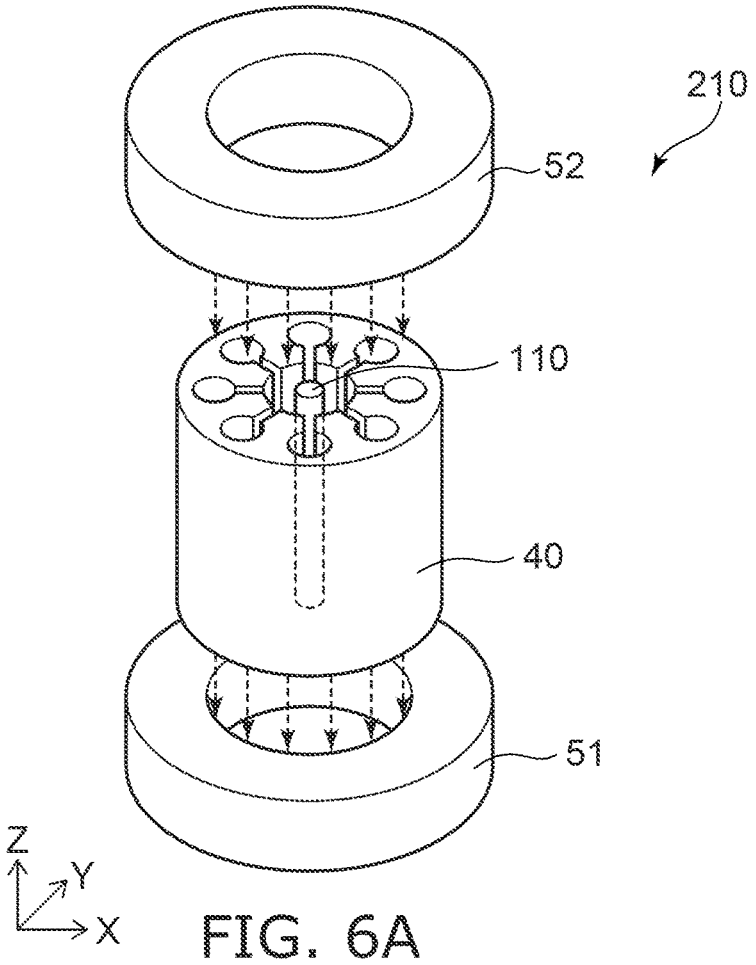
FIGS. 6A and 6B are schematic views illustrating a magnetron according to a third embodiment.
Figure 6B:
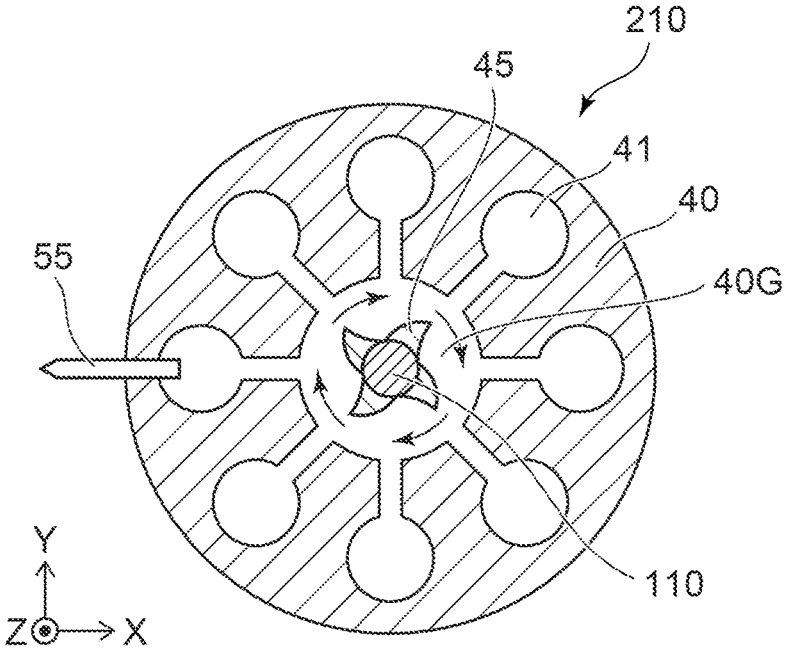

FIGS. 6A and 6B are schematic views illustrating a magnetron according to a third embodiment.

FIG. 6A is a perspective view. FIG. 6B is a cross-sectional view. As shown in FIGS. 6A and 6B, the magnetron 210 according to the embodiment includes an opposite electrode 40 and the electron-emitting electrode according to the first or second embodiment. The electron-emitting electrode 110 is illustrated in the example. The opposite electrode 40 faces the electron-emitting electrode 110. A gap 40G is provided between the electron-emitting electrode 110 and the opposite electrode 40. The air pressure in the gap 40G is less than 1 atmosphere. The electron-emitting electrode 110 is, for example, a cathode. The opposite electrode 40 is, for example, an anode.

A first magnet 51 and a second magnet 52 are provided as shown in FIG. 6A. The direction from the first magnet 51 toward the second magnet 52 is taken as a Z-axis direction. One direction perpendicular to the Z-axis direction is taken as an X-axis direction. A direction perpendicular to the Z-axis direction and the X-axis direction is taken as a Y-axis direction. The opposite electrode 40 faces the electron-emitting electrode 110 in the X-Y plane.

As shown in FIG. 6B, an electron cloud 45 that is based on the electrons emitted from the electron-emitting electrode 110 is formed by the magnetic field due to these magnets. For example, the electrons of the electron cloud 45 have cyclotron motion. A portion of the electrons that have cyclotron motion are incident on the electron-emitting electrode 110 due to a reverse impact phenomenon. According to the embodiment, the electrons that are included in the electron cloud 45 are incident on the second diamond member 22 of the electron-emitting electrode 110; and secondary electrons are emitted from the second diamond member 22.

As shown in FIG. 6B, a cavity resonator 41 is provided in the opposite electrode 40. Microwaves are emitted from an output antenna 55.

According to the embodiment, a magnetron can be provided in which the efficiency can be increased.

Figure 7:
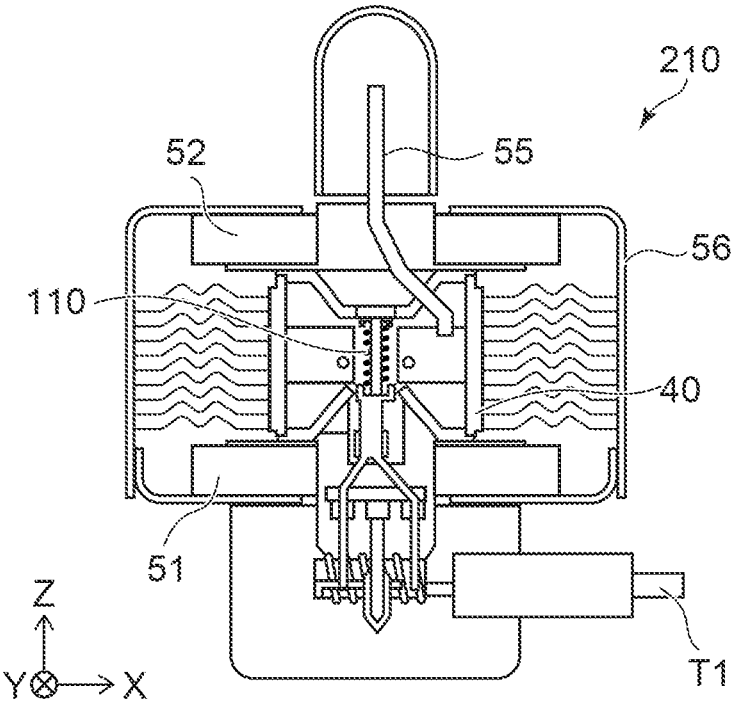
FIG. 7 is a schematic cross-sectional view illustrating the magnetron according to the third embodiment.

FIG. 7 is a schematic cross-sectional view illustrating the magnetron according to the third embodiment.

As shown in FIG. 7, a housing 56 is provided in the magnetron 210 according to the embodiment. The electron-emitting electrode 110 and the opposite electrode 40 are located inside the housing 56. The air pressure inside the housing 56 is less than 1 atmosphere.

According to the embodiment, thermions can be obtained at a low temperature. Refractory metal members at the periphery of the hot cathode can be replaced with inexpensive metals. For example, the cooling structures of fins, etc., can be simplified.

According to the embodiment, an electron-emitting electrode and a magnetron can be provided in which the efficiency can be increased.

In the specification, "a state of electrically connected" includes a state in which multiple conductors physically contact and a current flows between the multiple conductors. "a state of electrically connected" includes a state in which another conductor is inserted between the multiple conductors and a current flows between the multiple conductors.

Hereinabove, exemplary embodiments of the invention are described with reference to specific examples. However, the embodiments of the invention are not limited to these specific examples. For example, one skilled in the art may similarly practice the invention by appropriately selecting specific configurations of components included in electron-emitting electrodes such as members, diamond members, terminals, etc., from known art. Such practice is included in the scope of the invention to the extent that similar effects thereto are obtained.

Further, any two or more components of the specific examples may be combined within the extent of technical feasibility and are included in the scope of the invention to the extent that the purport of the invention is included.

Moreover, all electron-emitting electrodes, and magnetrons practicable by an appropriate design modification by one skilled in the art based on the electron-emitting electrodes, and the magnetrons described above as embodiments of the invention also are within the scope of the invention to the extent that the purport of the invention is included.

Various other variations and modifications can be conceived by those skilled in the art within the spirit of the invention, and it is understood that such variations and modifications are also encompassed within the scope of the invention.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An electron-emitting electrode, comprising:

a first member, a surface of the first member including a first region and a second region;

a first diamond member provided at the first region, the first diamond member including a first element, the first element including at least one selected from the group consisting of nitrogen, phosphorus, arsenic, antimony, and bismuth; and a second diamond member provided at the second region, the second diamond member including a second element, the second element including at least one selected from the group consisting of boron, aluminum, gallium, and indium.

2. The electron-emitting electrode according to claim 1, wherein a second height of the second diamond member referenced to the second region is greater than a first height of the first diamond member referenced to the first region.

3. The electron-emitting electrode according to claim 1, wherein a ratio of a surface area of the second region to a surface area of the first region is not more than 0.1.

4. The electron-emitting electrode according to claim 1, wherein the second diamond member extends along an extension direction of the first member.

5. The electron-emitting electrode according to claim 1, wherein the first region is located along a portion of a circumference having an extension direction of the first member as a center, and the second region is located at an other portion of the circumference.

6. The electron-emitting electrode according to claim 1, comprising:

a plurality of the first diamond members, the surface including a plurality of the first regions, the second region being between one of the plurality of first regions and an other one of the plurality of first regions, one of the plurality of first diamond members being located at the one of the plurality of first regions, an other one of the plurality of first diamond members being located at the other one of the plurality of first regions.

7. The electron-emitting electrode according to claim 6, wherein a ratio of a surface area of the second region to a sum of surface areas of the plurality of first regions is not more than 0.1.

8. The electron-emitting electrode according to claim 6, comprising:

a plurality of the second diamond members, the surface including a plurality of the second regions, the one of the plurality of first regions being between one of the plurality of second regions and an other one of the plurality of second regions, one of the plurality of second diamond members being located at the one of the plurality of second regions, an other one of the plurality of second diamond members being located at the other one of the plurality of second regions.

9. The electron-emitting electrode according to claim 8, wherein a ratio of a sum of surface areas of the plurality of second regions to a sum of surface areas of the plurality of first regions is not more than 0.1.

10. The electron-emitting electrode according to claim 1, further comprising:

a first electrode terminal; and a second electrode terminal, the first member being conductive, the first electrode terminal being electrically connected with a first end portion of the first member, the second electrode terminal being electrically connected with a first other-end portion of the first member.

11. The electron-emitting electrode according to claim 10, wherein a temperature of the first member is increased by a current supplied between the first end portion and the first other-end portion, and electrons are emitted from the first and second diamond members.

12. The electron-emitting electrode according to claim 1, further comprising:

a second member, the second member being conductive;

a first electrode terminal; and a second electrode terminal, the first electrode terminal being electrically connected with a second end portion of the second member, the second electrode terminal being electrically connected with a second other-end portion of the second member, the first member being between the second member and the first diamond member and between the second member and the second diamond member.

13. The electron-emitting electrode according to claim 12, wherein a temperature of the first member is increased by the second member being heated by a current supplied between the second end portion and the second other-end portion, and electrons are emitted from the first and second diamond members.

14. The electron-emitting electrode according to claim 1, wherein the first diamond member includes a first polycrystal.

15. The electron-emitting electrode according to claim 14, wherein the first polycrystal includes a (111) plane, and the first polycrystal does not include a (100) plane, or a proportion of the (100) plane in the first polycrystal is less than a proportion of the (111) plane in the first polycrystal.

16. The electron-emitting electrode according to claim 14, wherein the first diamond member includes a first hydrogen region provided at a surface of the first polycrystal, and the first hydrogen region includes hydrogen.

17. The electron-emitting electrode according to claim 1, wherein the second diamond member includes a second polycrystal.

18. The electron-emitting electrode according to claim 17, wherein the second polycrystal includes a (111) plane, and the second polycrystal does not include a (100) plane, or a proportion of the (100) plane in the second polycrystal is less than a proportion of the (111) plane in the second polycrystal.

19. The electron-emitting electrode according to claim 17, wherein the second diamond member includes a second hydrogen region provided at a surface of the second polycrystal, and the second hydrogen region includes hydrogen.

20. A magnetron, comprising:

the electron-emitting electrode according to claim 1; and an opposite electrode facing the electron-emitting electrode, a gap being provided between the electron-emitting electrode and the opposite electrode.

* * * * *